United States Patent [19]

Beckly

[11] Patent Number: 4,599,074

[45] Date of Patent: Jul. 8, 1986

[54] MAN OVERBOARD RETRIEVAL DEVICE

[76] Inventor: David E. Beckly, Knighton, Buckland Monachorum, Nr. Yelverton, S. Devon, England, PL20 7LH

[21] Appl. No.: 671,205

[22] Filed: Nov. 14, 1984

[30] Foreign Application Priority Data

Nov. 15, 1983 [GB] United Kingdom ..... 8330380

[51] Int. Cl.[4] ..... B63B 21/04

[52] U.S. Cl. ..... 441/80; 119/153; 114/221 R; 294/19.1

[58] Field of Search ..... 114/221 R; 441/84, 80; 294/19.1; 119/153; 43/87

[56] References Cited

U.S. PATENT DOCUMENTS

| | | | |
|---|---|---|---|
| 1,380,891 | 6/1921 | Gaines | 119/153 |
| 1,883,598 | 10/1932 | Dahl | 119/153 |
| 2,488,962 | 11/1949 | Christoffer | 119/153 |
| 2,704,052 | 3/1955 | Wood | 119/153 |
| 3,165,091 | 1/1965 | Welton | 119/153 |
| 3,224,404 | 12/1965 | Jong | 114/230 |

FOREIGN PATENT DOCUMENTS

| | | | |
|---|---|---|---|
| 577911 | 6/1957 | Belgium | 119/153 |

*Primary Examiner*—Trygve M. Blix
*Assistant Examiner*—Edwin L. Swinehart
*Attorney, Agent, or Firm*—Cushman Darby & Cushman

[57] ABSTRACT

A man-overboard retrieval device comprises a rigid, tubular boom attachable at an inboard end to an anchorage on a boat and having at its other, outboard end a strap which forms a semi-rigid, self-supporting bight which can be placed around a man in the water. A draw-cord attached to a free end of the strap extends through the boom and emerges at the inboard end where it can be pulled to tighten the bight around the man before being fastened in a cleat. A hoist on the boat can be attached to a hoisting eye on the boom either at the inboard end or near the strap, as convenient, for hoisting the device and the rescued man onboard.

11 Claims, 8 Drawing Figures

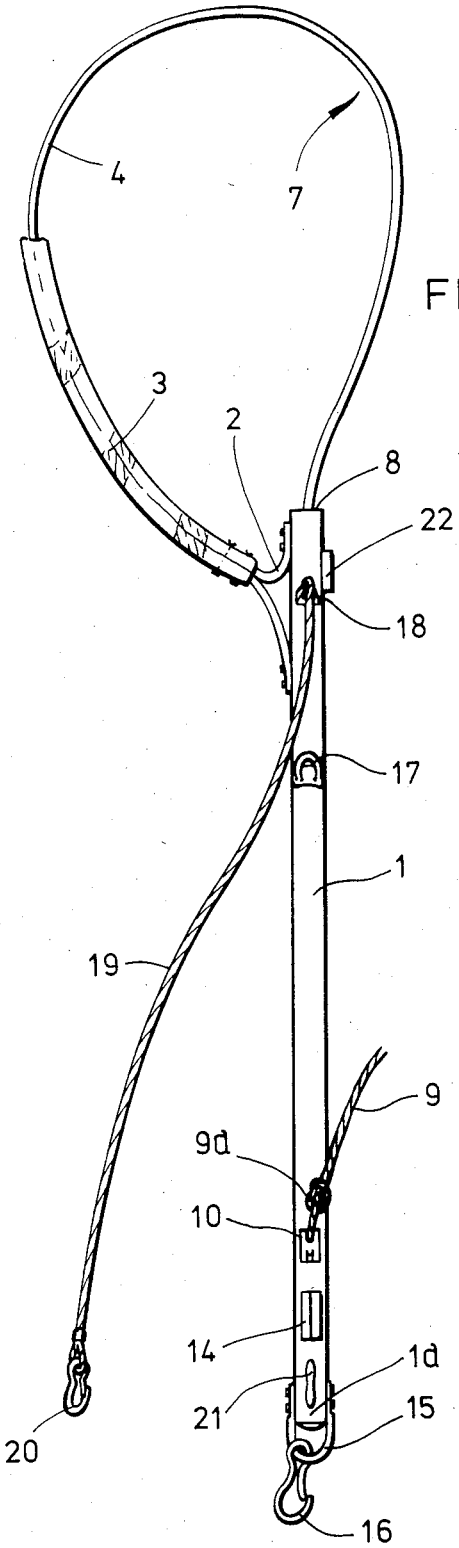
FIG 1
FIG 2
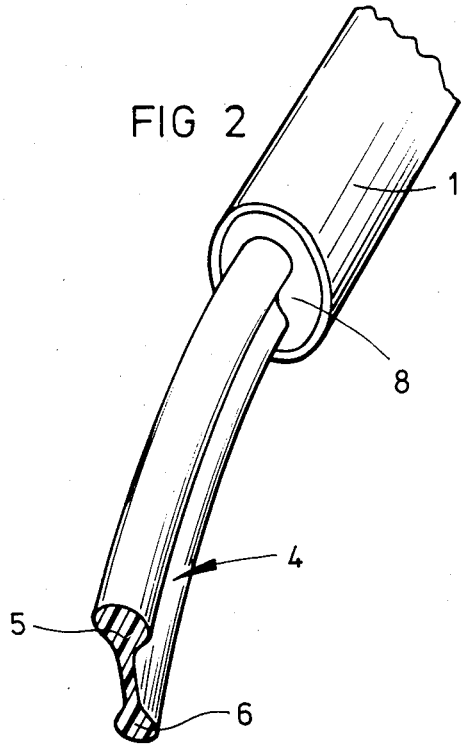

MAN OVERBOARD RETRIEVAL DEVICE

BACKGROUND OF THE INVENTION

This invention relates to a man-overboard retrieval device, that is, a device for rescuing from the water a person who has fallen overboard from a boat or ship.

When a person falls overboard from a vessel, the effects of shock and hypothermia, particularly in cold water, combined with the weight of waterlogged clothing, and perhaps injury, often make it impossible for him to climb back onto the vessel unaided even where devices such as ladders extending below the water-line are available. Moreover, those remaining on the vessel may find it difficult, if not impossible, to haul the person out of the water, particularly in severe weather conditions.

The conventional lifebelt carried on a line may be capable of giving support to the person in the water, but is generally of little help in the more difficult task of hauling the man inboard from the water. Sometimes, therefore, attempts are made to secure a rope around the person in the water or to gather him in a headsail to enable him to be hauled or rolled up the boat's side to safety, but this, in itself, may necessitate a rescuer entering the water, adding to the risks involved. Such methods are difficult enough in themselves but are aggravated when the vessel concerned is a yacht under sail and it is necessary to manoeuvre it head-to-wind, next to the person in the water, while the rescue attempts are made.

OBJECT OF THE INVENTION

The present invention seeks to provide a simple man-overboard retrieval device which avoids some of the disadvantages associated with earlier and conventional rescue techniques.

SUMMARY OF THE INVENTION

According to the present invention there is provided a man-overboard retrieval device comprising a rigid boom having at one end a strap which forms a semi-rigid but flexible, self-supporting bight which can be placed around a man in the water, a draw-cord attached to the strap and extending along the boom to enable the bight to be tightened from the end remote from the said one end, and an attachment point on the boom for connection to lifting tackle on the vessel for hauling the boom and the rescued man from the water.

The main advantage of the device according to the invention is that it can be operated by a single rescuer who, while himself standing safely on the vessel, can place the bight over the head and shoulders of the person in the water and can tighten it to grip him securely so that he can be drawn to the side of the vessel. The attachment point can then be connected to suitable lifting tackle which, even if manually operated, facilitates the difficult task of hauling the man onboard.

The boom is preferably provided with a releasable clip at its end opposite the strap so that it can be anchored to, for example, a guard rail or stanchion of the vessel when the rescued person has been brought to the side in order to free the rescuer to connect the lifting tackle to the boom and prevent the rescued person from drifting away again. A flexible line may also be attached to the boom for securing the boom to the vessel while rescue is taking place to prevent loss of the retrieval device overboard. The line is preferably attached to the end of the boom adjacent the strap.

The attachment point for the lifting tackle preferably comprises a hoisting eye located at any convenient point on the boom: for example, the eye may be at the end opposite the strap for attachment to a halyard of a yacht or nearer the strap for connection to a deck-mounted winch. Several eyes may be provided or a rope or line may be used for hauling the device onboard.

As mentioned above, the strap of the retrieval device must form a self-supporting bight; that is, it must form an open loop at the end of the boom, with substantially no tendency to collapse or twist so that it can be located easily over the person in the water. It must, however, be sufficiently flexible to allow it to be tightened around the person. To this end, the strap may conveniently be formed with a suitable, cross-section from extruded plastics material, possibly with internal reinforcement. Various cross-sectional shapes have been found to be suitable one example being a generally T-shaped section. Preferably the strap has a generally flat cross-section in a plane perpendicular to the plane of the loop and, in a preferred embodiment, it has longitudinally extending beads of enlarged thickness along each edge. The longitudinal bead along one edge of the strap is preferably thicker than the other bead so that the strap has a generally-asymmetric dumb-bell cross section.

The bight may be totally self-supporting in the open condition or the end of the boom carrying the strap may be shaped to form a rigid part of a loop completed by the bight so as to help to keep the bight open. In a preferred embodiment of the invention, a yoke is attached to, and projects laterally from the said one end of the boom, the strap being anchored to the yoke and extending from the yoke to a guide aperture at the adjacent end of the boom. The guide aperture preferably has a cross-sectional shape which is complementary to that of the strap so that the strap is freely slidable in the aperture but cannot twist. A stop or other means are preferably provided to prevent the strap being withdrawn completely from the guide aperture.

The draw-cord which is used to tighten the strap may extend along the outside of the boom or along a groove therein, but preferably extends through a central bore therein. The cord is preferably attachable to a cleat or is otherwise fastenable to the boom once the bight has been tightened to a desired extent to prevent the bight extending again while a rescued person is being hauled from the water.

Suitable cleats may also be provided for attachment of the free ends of the cord and any other line or rope carried by the device while the device is stowed out of use.

The surface of the strap which will contact the body of a person being rescued is preferably rounded or is enclosed in a flexible sleeve so as not to cause undue bruising.

BRIEF DESCRIPTION OF THE DRAWINGS

The invention will be further described, by way of example only, with reference to the accompanying drawings, in which:

FIG. 1 is a diagrammatic plan view of a man-overboard retrieval device according to a preferred embodiment of the invention;

FIG. 2 is a fragmentary perspective view, on an enlarged scale, of part of the device shown in FIG. 1 showing the cross-sectional profile of the strap of the device;

Figure 4:
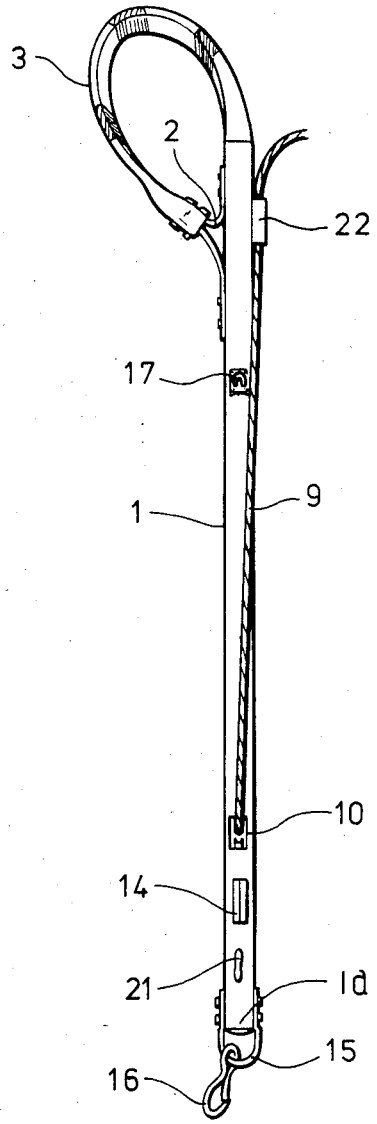
Figure 3:
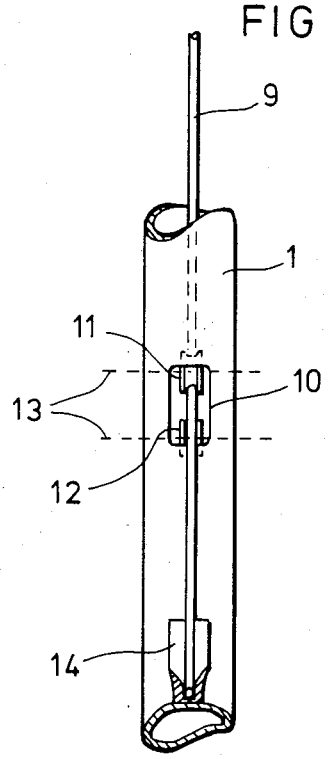
Figure 5:
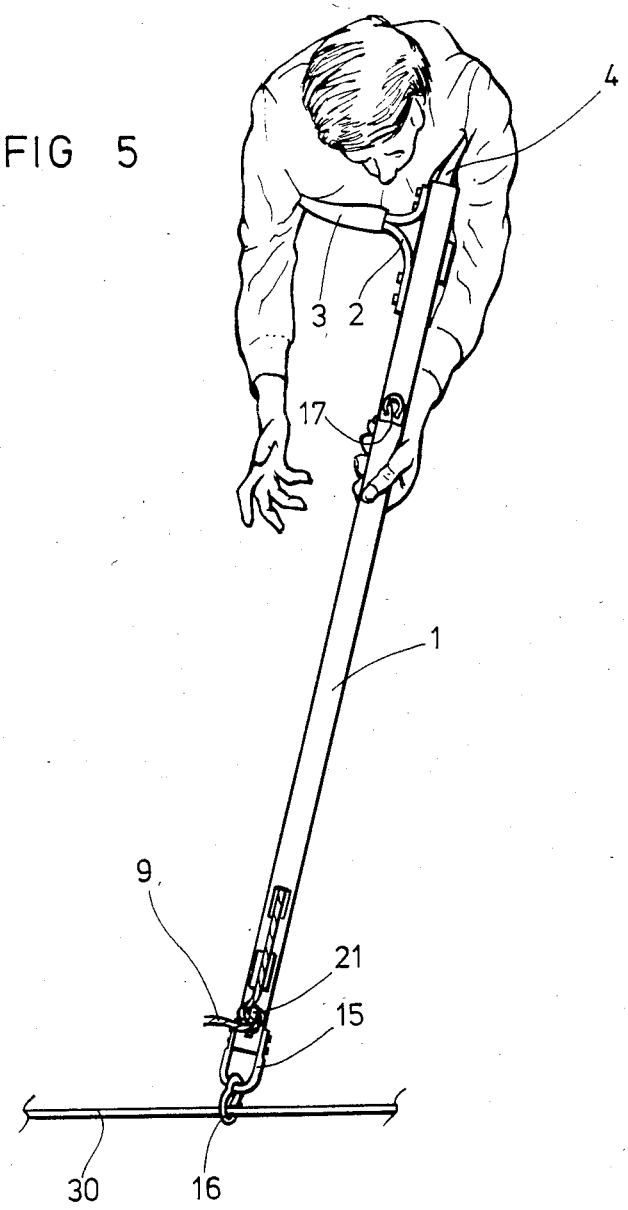
Figure 6:
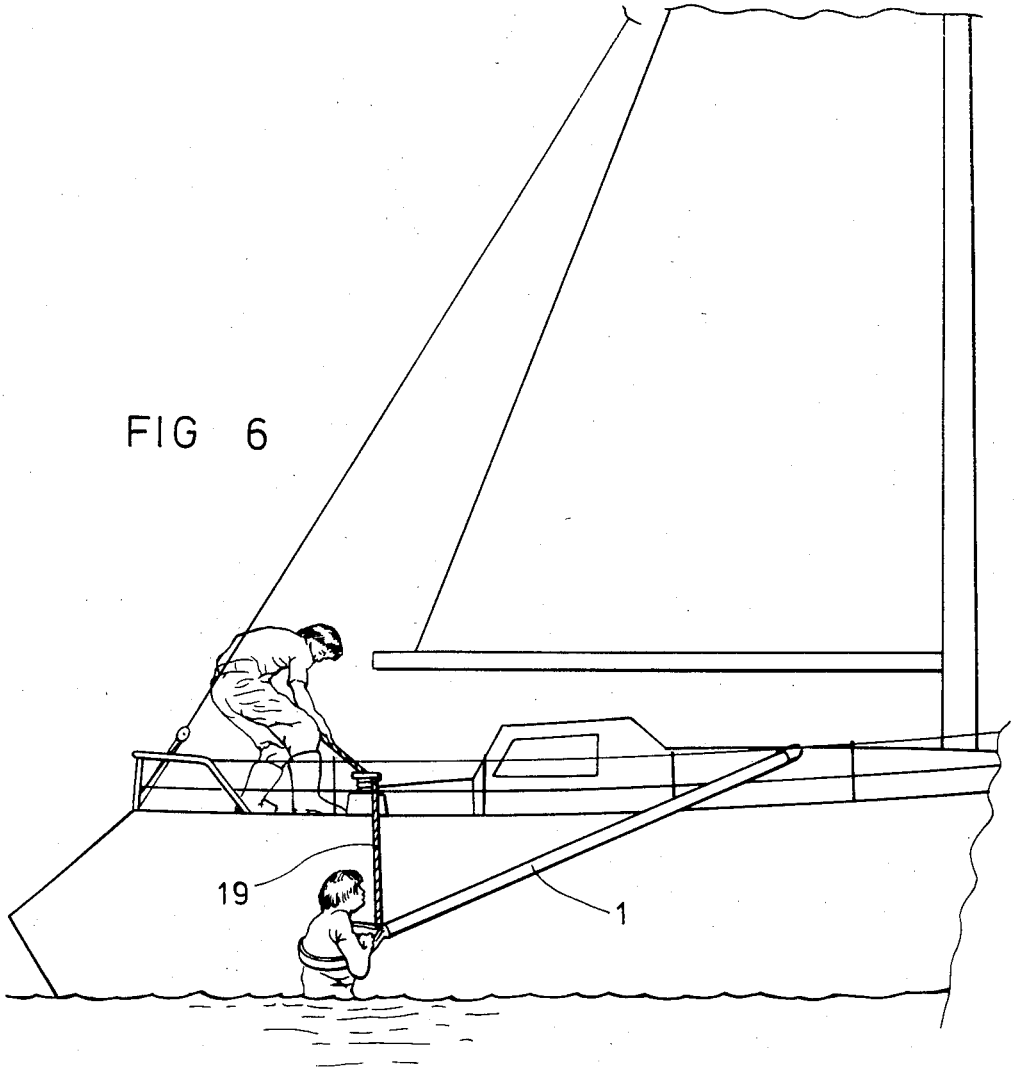
Figure 7:
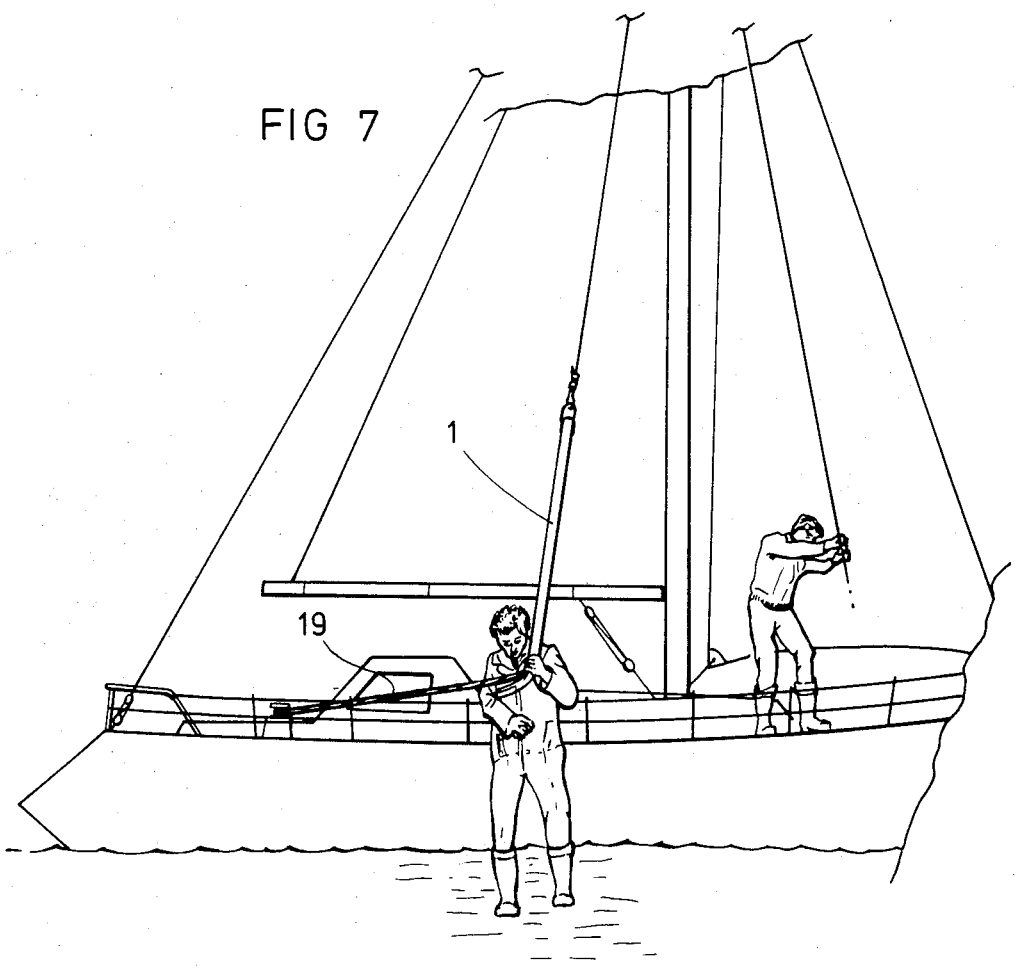
Figure 8:
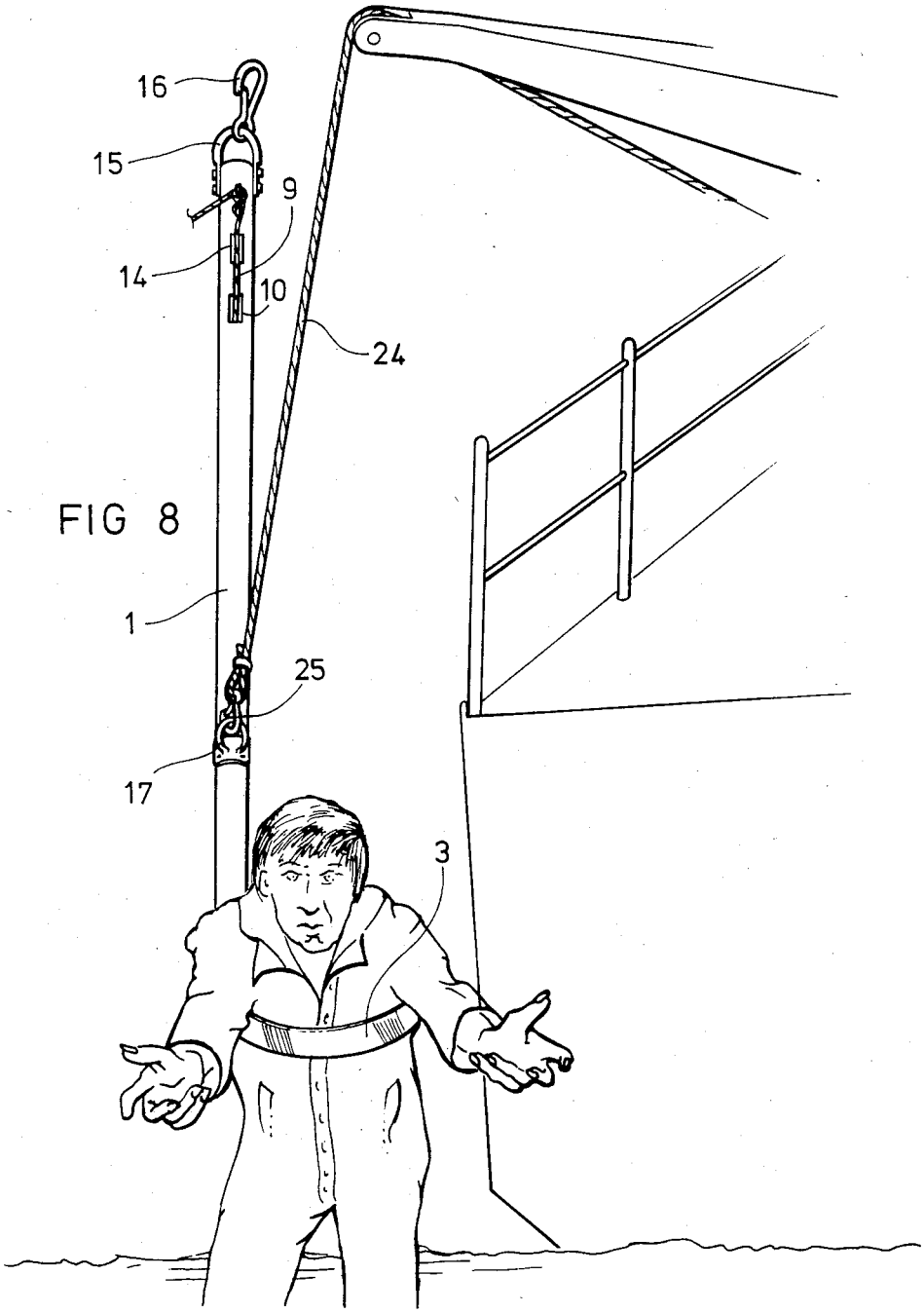

FIG. 3 is a partially broken-away plan view of part of the device of FIG. 1 on an enlarged scale;

FIG. 4 is a plan view of the device shown in FIG. 1, with its rescue loop in a stowed condition;

FIG. 5 is a plan view of the device of FIG. 1 showing a stage in use of the device for gripping a man in the water during rescue;

FIGS. 6 and 7 show two successive stages of rescue of a man overboard from a yacht, using the device of the present invention; and FIG. 8 illustrates another method of retrieval of a person from the water using the device and ship-board hoisting gear.

DESCRIPTION OF THE PREFERRED EMBODIMENTS

The illustrated man-overboard retrieval device according to the invention has a rigid boom 1 formed by a length of aluminium tube. A yoke 2 is attached to, and projects laterally from one end of the boom 1, being secured to the latter by bolts or rivets. One end of a sleeve 3 of flexible material, such as plastics or fabric, is attached to the yoke 2 and encloses an end portion of a flexible strap 4 which is also anchored to the yoke 2 within the sleeve 3.

The strap 4 consists of extruded plastics material, which may be internally reinforced, and, as shown in FIG. 2, has a generally flat cross-section with two longitudinally extending edge beads 5, 6, one bead 5 being thicker than the other bead 6: the strap thus effectively has an asymmetric dumb-bell cross-section. This cross-section allows the strap 4 suffucient flexibility for it to be bent into a bight 7, as illustrated in FIG. 1, but gives the strap sufficient rigidity, in a direction perpendicular to the plane of the bight, for the bight to be semi-rigid and self-supporting.

The end of the strap 4 opposite that which is anchored to the yoke 2 is inserted in a plastics stopper 8 in the end of the tubular boom 1 carrying the yoke 2. The stopper 8 has an aperture with a cross-section complementary to that of the strap 4 so that the strap 4 slides freely in the stopper 8 but cannot twist.

Within the hollow boom 1 the strap 4 has a permanent attachment to a draw-cord 9 which extends through the bore of the tubular boom 1 and through a sheave box housed within the boom 1 adjacent its end 1*a* which will be termed the "inboard" end, opposite that to which the strap 4 is attached. The cord 9 emerges through a lateral aperture 10 from the sheave box as best seen in FIG. 3.

Referring to FIG. 3, the sheave box houses two sheaves 11, 12 rotatable about respective parallel axes indicated 13 perpendicular to the axis of the boom 1 and parallel to the plane of the aperture 10. The cord 9 in fact passes under (as seen in FIG. 4) the sheave 11 closer to the stopper 8, and between the two sheaves 11, 12 to emerge from the aperture 10 and may either turn back around the sheave 11 towards the "outboard" end of the boom 1, as shown in FIG. 1, or, as shown in FIG. 3, may continue over the sheave 12 towards the inboard end 1*a* of the boom. Here it may be clamped in a generally V-section jamming cleat 14 fixed to the boom 1 between the aperture 10 and the inboard end 1*a*. Near its free end, the cord 9 has a knot 9*a* for reasons which will be explained below.

Actually at the inboard end 1*a* of the boom 1 is a shackle 15 which carries a releasable spring clip 16 for releasably attaching the inboard end 1*a* of the boom 1 to a suitable anchorage, such as a stanchion or guard rail 30 of the boat, in use (see FIG. 5).

At the "outboard" end of the boom 1, that is, the end adjacent the yoke 2, the boom 1 has an eye or lug 18 to which one end of a hauling rope 19 is attached, the other end having a quick release clip 20 which may be clipped to the shackle 15 for stowage. The rope 19 need not be provided for a device intended for use on a lifeboat and, for clarity of illustration, is not shown in all the drawings.

Intermediate the aperture 10 and the lug 18 are two eyes 17 (only one visible), diametrally opposite each other, one on either side of the plane of the bight 7. Hoisting gear can be attached to one of the eyes 17, in use, as will be explained below.

The device, when not in use, would normally be stowed in a conveniently accessible position, for example on the deck or superstructure of a boat or clipped to a backstay or shroud. In its stowed condition (FIG. 4) the cord 9 is drawn through the aperture 10 to its fullest extent, closing the bight 7 to a minimum size dictated by the abutment of the free end of the sleeve 3 against the stopper 8 at the outboard end of the boom 1. The projecting part of the cord 9 is laid along the outside of the boom 1 and its free end is secured in a cleat 22 adjacent the outboard end of the boom 1. The cleat 22 is preferably a jamming cleat but may be of any other convenient type. The hauling rope 19 would be clipped to the shackle 15.

When the device is removed from its stowage in order to retrieve a person who has fallen overboard, the free end of the cord 9 is first released from the cleat 22 and the strap 4 is drawn out of the boom 1 to extend the bight 7: the opening of the bight 7 is limited by the knot 9*a* formed in the cord 9 which engages the sides of the sheave-box aperture 10. The bight 7 with the laterally extending yoke 2 forms a closed loop which is large enough to pass over the head and shoulders of the person in the water, and the overall structure of the strap 4, the yoke 2 and the stopper 8 ensures that the bight 7 is sufficiently self-supporting to remain in its fully open condition, without twisting.

Before the loop is passed to the person in the water it is generally advisable to anchor the boom 1 to the boat, for example to a guard rail or stanchion. This is effected by means of the hauling rope 19 and the clip 20.

Once the loop has been passed over the head and shoulders of the person in the water and under his arms, the draw-cord 9 can be pulled to tighten the bight 7 around the upper part of the body and jammed in the cleat 14. The degree of tightness can easily be adjusted by releasing the cord from the cleat 14, pulling it in or letting it out and rejamming it in the cleat 14 when the desired degree of tightness has been achieved. An additional cleat 21 is provided between the cleat 14 and the shackle 15 to which the cord 9 is secured to prevent the bight extending again during the subsequent procedure.

At a convenient moment during or after this process, the inboard end 1*a* of the boom 1 is clipped to a guard rail or stanchion of the boat by means of the clip 16 as shown in FIG. 5. The person being rescued is now securely attached to the boat by both the clip 20 and the clip 16 and cannot drift away or under the hull. It is now possible to move the clip 20 without fear of the device 1 being accidentally lost overboard, thus losing the rescued person again; it is particularly important that the device is attached to the boat at all times when it is used by persons unskilled in rescue, or in heavy seas or bad weather conditions.

The clip 20 is next released and the rope 19 used to draw the rescued person gently to the side of the boat and partly out of the water to a position such as that shown in FIG. 6. The rope 19 is again securely fastened to a convenient anchorage at this point and then the rescued person may safely be left while preparations are made to hoist him onboard. This may be effected simply by manpower if enough deckhands are available, but in most cases it is more practical to make use of hoisting gear available on the boat. In the case of the yacht of FIGS. 6 and 7, a sail is lowered (if necessary) and the sail halliard 25 clipped to the shackle 16 at the inboard end of the boom 1. The clip 16 is then released from its anchorage point on the vessel and the halliard 25 hoisted (FIG. 7) to lift the person cleanly from the water. During this process it may be necessary to slacken the rope 19 and the rope 19 can be used to steady the person as he is hoisted clear of the water and on board.

Referring to FIG. 8 of the drawings, this shows a rescue from a lifeboat in which the hoisting gear used would be the deck-mounted winch.

As is seen in FIG. 8, the lifeboat winch has a rope 24 with a hook 25 at its free end which can be hooked into whichever of the eyes 17 on the boom 1 is more readily accessible. The clip 16 attaching the boom 1 to the boat is released at a convenient moment before or preferably after attachment of the hook to the eye 17. Once this has been effected, the winch may be operated to lift the person from the water so that he may be brought safely onboard. Since, in the case of rescue by a lifeboat, the device is used by several skilled persons, the hauling rope 19 may not be needed.

It should also be mentioned, that while the rescued person is held and lifted by the device he is actually supported by the flexible sleeve 3 which acts as a cushion around the strap 4 and minimises general bruising to the body.

The strap 4 has the rounded beads 5, 6 along its edges partly to ensure that pressure exerted on the body through the sleeve 3 is minimised, the larger bead 5 being intended to be located under the armpits. A further reason is that a thin rectangular-section strap tends to whip from side-to-side in the plane of the bight making it difficult to locate over a man in the water: the provision of edge beads reduces this tendency while still allowing the strap the necessary flexibility for the bight to be contracted.

What is claimed is:

1. A man-overboard retrieval device for retrieving a man who has fallen overboard from a vessel into the water comprising:

a rigid boom having an inboard end and an outboard end;

a strap connected at one end to said outboard end of said boom and having a generally flat cross-section with longitudinally extending beads of enlarged thickness along each edge;

a draw-cord attached to the other end of said strap and extending along said boom to said inboard end, said strap forming, by virtue of its cross-sectional shape, a semi-rigid, flexible, self-supporting bight at said outboard end which can be placed around said man to be retrieved and which can be tightened from said inboard end by means of said draw-cord; and attachment means on said boom for adapted connection to hoist means on said vessel for hoisting said man out of the water.

2. A retrieval device according to claim 1, wherein said boom is provided with a releasable clip at said inboard end.

3. A retrieval device according to claim 1, wherein the longitudinal bead along one edge of said strap is thicker than the other bead so that the strap has a generally asymmetric dumb-bell cross-section.

4. A retrieval device according to claim 1, wherein said strap is of extruded plastics material.

5. A retrieval device according to claim 1, wherein a yoke is attached to, and projects laterally from, said outboard end of said boom and said outboard end defines a guide aperture for said strap, and wherein said strap is anchored at said one end to said yoke and forms said bight which extends from the yoke to said guide aperture, said strap passing through said aperture to its attachment to said draw-cord.

6. A retrieval device according to claim 5, wherein that end portion of said strap anchored to said yoke is enclosed in a sleeve of flexible material which, upon drawing of the draw-cord to contract the bight, is brought into abutment with said outboard end of the boom.

7. A retrieval device according to claim 5, wherein said boom is tubular, said guide aperture is formed in a plug fitted in said outboard end and wherein said guide aperture has a cross-sectional shape which is complementary to the cross-sectional shape of the strap.

8. A retrieval device according to claim 7, wherein said tubular boom defines a lateral aperture adjacent said inboard end communicating with the central base of said boom and wherein said draw-cord extends through said central base and emerges therefrom through said lateral aperture.

9. A retrieval device according to claim 8, wherein a cleat is provided adjacent said lateral aperture for anchorage of said draw-cord.

10. A retrieval device according to claim 1, wherein a flexible line is attached to said boom adjacent said outboard end, said line having an end connector for attachment to an anchorage on said vessel.

11. A retrieval device according to claim 1, wherein said attachment means comprise a hoisting eye.

* * * * *